US007442078B1

(12) United States Patent
Hsu

(10) Patent No.: US 7,442,078 B1
(45) Date of Patent: Oct. 28, 2008

(54) MICRO-ADJUSTABLE AND QUICK-LOCKING ADAPTOR FOR ELECTRICAL JUNCTION BOX

(76) Inventor: Run Chi Hsu, 4th Floor, No. 20, Hoping Road, Panchiao, Taipei Hsien (TW)

( * ) Notice: Subject to any disclaimer, the term of this patent is extended or adjusted under 35 U.S.C. 154(b) by 0 days.

(21) Appl. No.: 12/008,763

(22) Filed: Jan. 15, 2008

(51) Int. Cl.
*H01R 13/73* (2006.01)

(52) U.S. Cl. ..... 439/552; 439/553; 174/359

(58) Field of Classification Search ..... 439/552, 439/553, 557; 174/359
See application file for complete search history.

(56) References Cited

U.S. PATENT DOCUMENTS 973,567 A * 10/1910 Russell ..... 439/553
6,596,939 B1 * 7/2003 Gretz ..... 174/359

* cited by examiner

*Primary Examiner*—Tho D Ta

(57) ABSTRACT

An adaptor for electrical junction box comprises: a split sleeve insertable through a wall opening of a box wall of a junction box, and coupled on a cable connector; a plurality of resilient chucking members each integrally formed on the sleeve and sloping rearwardly upwardly from the sleeve to be resiliently compressibly engaged with the wall opening; each chucking member having a plurality of ratchet teeth gradationally formed on the chucking member, whereby upon a forward insertion of the adaptor into the wall opening of the junction box, the split sleeve will be resiliently fastened on the cable connector, and the wall opening will be firmly engaged with the ratchet teeth to stably lock the adaptor and the cable connector on the box wall to prevent a backlash movement of the adaptor and the cable connector.

4 Claims, 3 Drawing Sheets

MICRO-ADJUSTABLE AND QUICK-LOCKING ADAPTOR FOR ELECTRICAL JUNCTION BOX

BACKGROUND OF THE INVENTION

U.S. Pat. No. 6,827,604 disclosed a "One-piece Snap-in Connector for Electrical Junction Box" characterized by snap-in locking fingers positioned apart on the leading or the insertion end of the electrical connection fitting.

The locking fingers (20, 21) may lock the connector on a wall of the junction box. However, there is not provided with teeth on the fingers in order to firmly "bite" the opening edge of the box wall. If the box wall is very thin (having smaller thickness), the connector may not be firmly or stably fastened on the wall of the junction box, because an aperture exists between the fingers (20) and the collar (16), thereby allowing a free sliding movement of the front portion of the connector through the opening (12) of the box wall, and causing unstable mounting of the connector on the electrical junction box.

The present inventor has found the drawbacks of the prior art, and invented the present adapter which can be micro-adjustable and quickly lockable on a junction box.

SUMMARY OF THE INVENTION

The object of the present invention is to provide an adaptor for electrical junction box comprising: a split sleeve insertable through a wall opening of a box wall of a junction box, and coupled on a cable connector; a plurality of resilient chucking members each integrally formed on the sleeve and sloping rearwardly upwardly from the sleeve to be resiliently compressibly engaged with the wall opening; each chucking member having a plurality of ratchet teeth gradationally formed on the chucking member, whereby upon a forward insertion of the adaptor into the wall opening of the junction box, the split sleeve will be resiliently fastened on the cable connector, and the wall opening will be firmly engaged with the ratchet teeth to stably lock the adaptor and the cable connector on the box wall to prevent a backlash movement of the adaptor and the cable connector.

DETAILED DESCRIPTION

Figure 1:
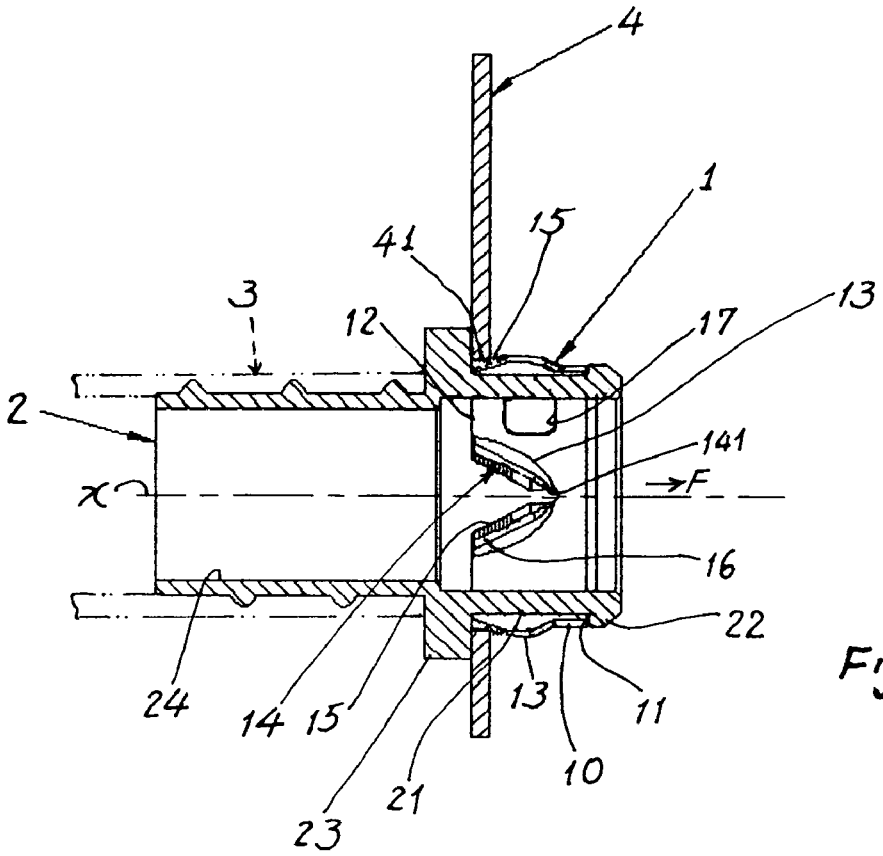
FIG. 1 is a sectional drawing of the present invention as coupled to a cable connector secured on a wall of a junction box.
Figure 2:
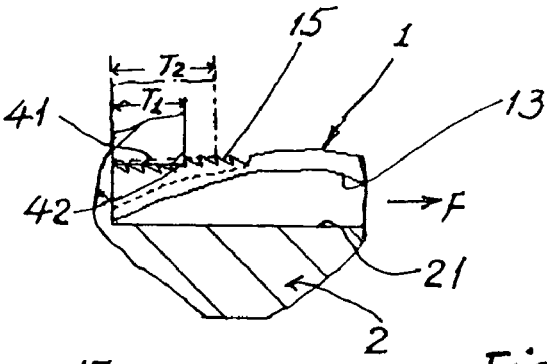
FIG. 2 is a partial enlarged view of the present invention as shown in FIG. 1.
Figure 3:
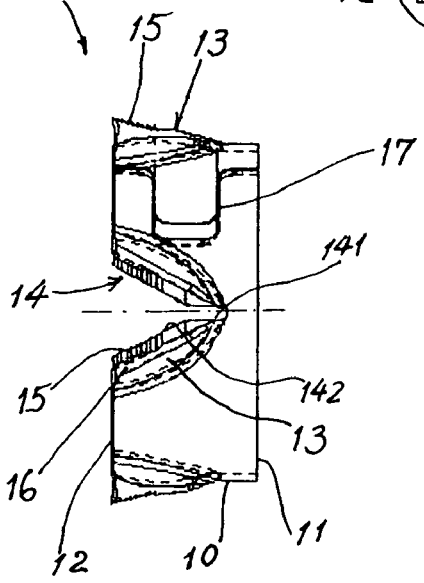
FIG. 3 is an illustration of the present invention.

As shown in FIGS. 1~3, the present invention discloses an adaptor 1, which is coupled to a cable connector 2 for connecting a cable 3 especially for a connecting a metal clad cable in order to be locked and secured on a box wall 4 of an electrical junction box.

The adaptor 1 includes: a split sleeve 10 generally formed as a cylindrical shape and insertable through a wall opening 41 of the box wall 4 and releasably coupled to a front tube portion 21 of the cable connector 2, a leading edge portion 11 formed on a front end of the sleeve 10 to be contiguous to a front arrow-head portion 22 of the cable connector 2, and a plurality of resilient chucking members 13 each integrally resiliently formed on the sleeve 10 and sloping rearwardly upwardly from the leading edge portion 11 towards a trailing edge portion 12 of the sleeve 10 to be resiliently compressibly engaged with the wall opening 41, a notch 14 circumferentially cut out in the sleeve and diverging rearwardly from the leading edge portion 11 towards the trailing edge portion 12, a pair of ridge portions 16 formed on each chucking member 13 and respectively juxtapositioned to the notch 14 and each ridge portion 16 having a plurality of ratchet teeth 15 gradationally formed on the ridge portion 16; having each tooth of the ratchet teeth 15 forwardly sliding over a rim 42 of the wall opening 41 when forwardly inserting the front tube portion 21 of the cable connector 2 through the wall opening 41 (direction F), and each tooth rearwardly retarded by the rim 42 of the wall opening 41 as shown in FIG. 2, thereby limiting a backlash movement of the adaptor 1 and the cable connector 2 as coupled with the adaptor 1.

Each notch 14 may be formed as a Y shape, including a front slit 141 linearly cut out in a front portion of the sleeve 10, and a diverging port 142 enlarged rearwardly from the front slit 141 towards the trailing edge portion 12 of the sleeve 10, having the pair of ridge portions 16 juxtapositionally formed on opposite sides of the diverging port 142 and each ridge portion 16 having the plurality of ratchet teeth 15 gradationally formed on the ridge portion 16, whereby upon a forward insertion of the cable connector 2 into the wall opening 41 of the box wall 4 of the junction box, each resilient chucking member 13 will be compressed radially by the rim 42 of the wall opening 41 to radially fasten the split sleeve 10 on the front tube portion 21 of the cable connector 2 (FIGS. 1 and 2), while the rim 42 of the box wall 4 will be bitten or engaged by each tooth of the ratchet teeth 15 to thereby lock the adaptor 1 and cable connector 2 on the wall of the junction box in a quick way.

Since each of the ratchet teeth 15 may be gradually engaged with the wall opening 41 in a tooth-by-tooth way, the adaptor 1 and the connector 2 will be stably locked on the box wall in a micro-adjustable way, especially in view of FIG. 2 to be either suitably adapted for a thin wall having a thinner thickness T1 or a thick wall (dotted line) having a thicker thickness T2.

Therefore, the present invention provides an adaptor 1 for a cable connector, which can be stably locked on a junction box wall simultaneously in a quicker way, but also in a micro-adjustable way, to be superior to the prior art which is especially lacking of micro-adjusting mechanism as effected by the present invention.

The adaptor 1 may be made of elastic materials, including steel, plastic or metals, not limited in the present invention.

The adaptor 1 includes a free-end slit 17 longitudinally cut out through a length (or height) of the sleeve 10 to be releasably coupled with the cable connector 2.

The cable connector 2 further includes a shoulder portion 23 annularly formed on a rear tube portion 24 of the connector 2, opposite to the front tube portion 21, to be forwardly limited against the box wall 4 as shown in FIG. 1. A cable 3 may be fastened on the rear tube portion 24 as shown in FIG. 1.

Figure 4:
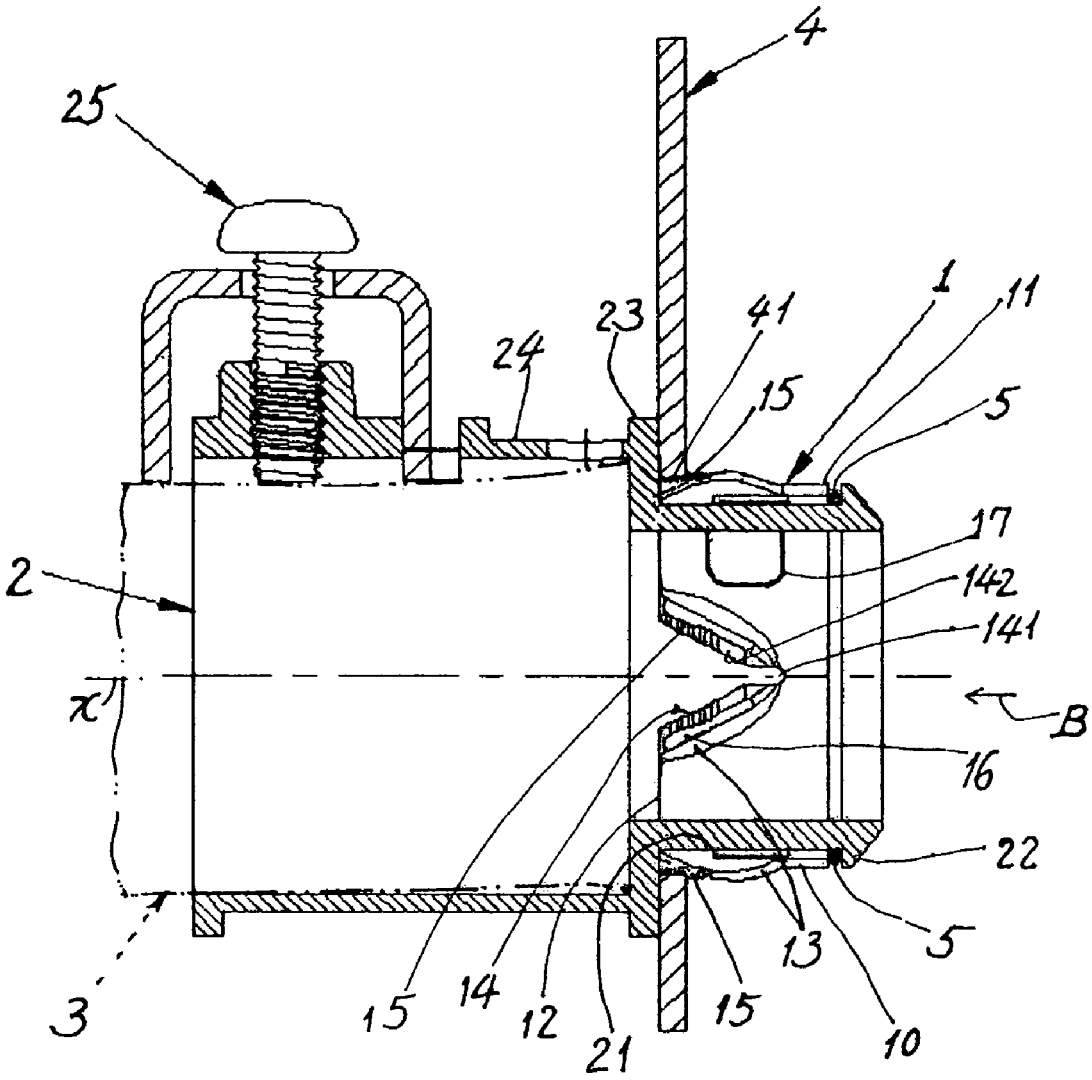
FIG. 4 shows another preferred embodiment of the present invention.

The adaptor 1 may further include a limiting ring 5, which may be a rubber ring, retained in between the front arrow-head portion 22 of the cable connector 2 and the leading edge portion 11 of the sleeve 10, to absolutely prevent a backward retraction (B) of the cable connector 2 as shown in FIG. 4.

In FIG. 4, a cable fastener 25 is further provided on the cable connector 2 in order to firmly hold the cable 3 in the connector 2.

Figure 5:
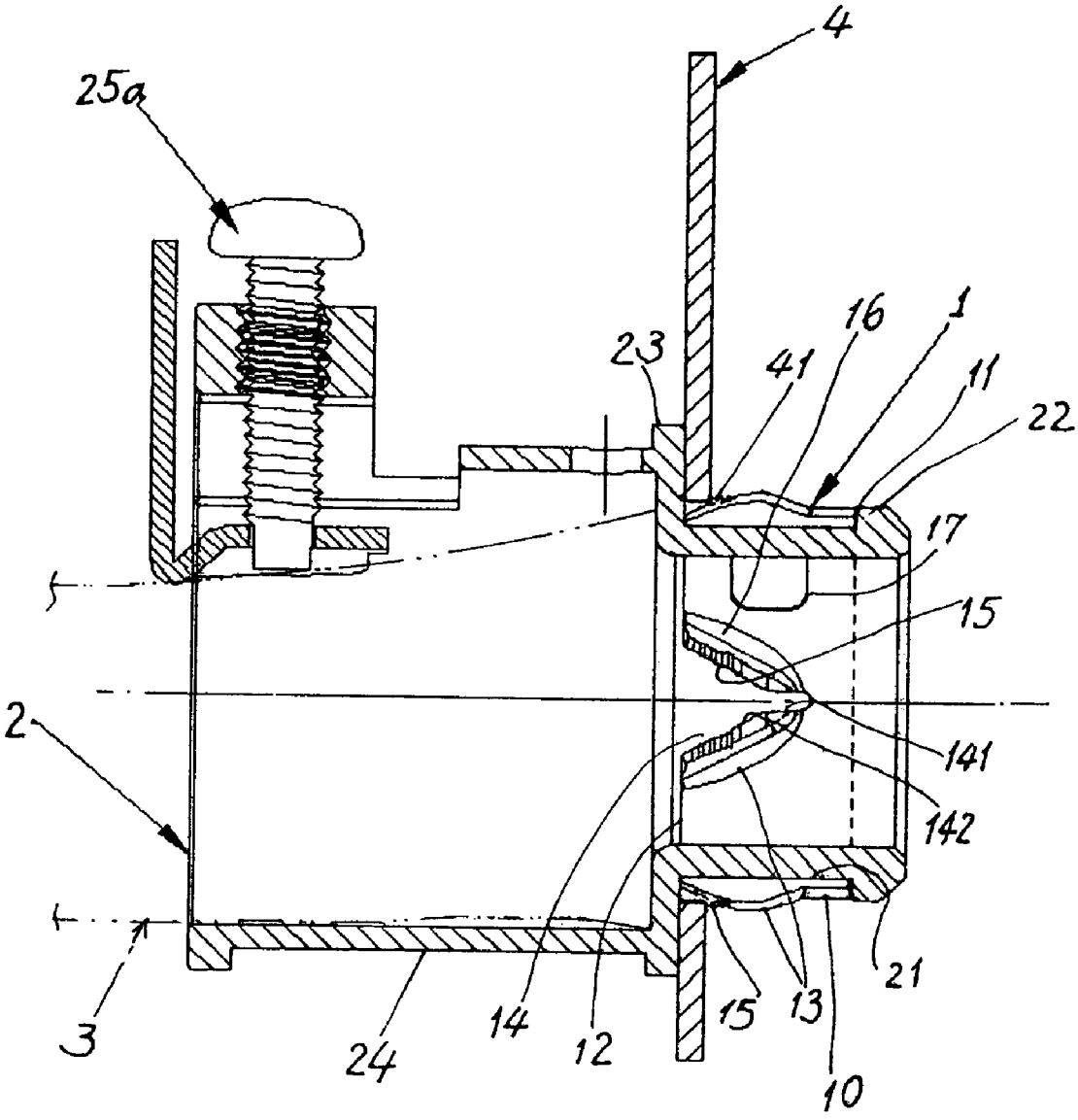
FIG. 5 shows another cable connector as used in the present invention.

In FIG. 5, another cable fastener 25*a* is provided for fastening the cable 3 in the connector 2.

The present invention may be further modified without departing from the spirit and scope of the present invention.

I claim:

1. An adaptor for electrical junction box comprising: a split sleeve insertable through a wall opening of a box wall of a junction box, and coupled on a cable connector; a plurality of resilient chucking members each integrally formed on the sleeve and sloping rearwardly upwardly from the sleeve to be resiliently compressibly engaged with the wall opening; each said chucking member having a plurality of ratchet teeth gradationally formed on the chucking member, whereby upon a forward insertion of the adaptor into the wall opening of the junction box, the split sleeve will be resiliently fastened on the cable connector, and the wall opening will be firmly engaged with the ratchet teeth to stably lock the adaptor and the cable connector on the box wall to prevent a backlash movement of the adaptor and the cable connector;

said adaptor including: said split sleeve generally formed as a cylindrical shape and insertable through the wall opening of the box wall and releasably coupled to a front tube portion of the cable connector, a leading edge portion formed on a front end of the sleeve to be contiguous to a front arrow-head portion of the cable connector, and said plurality of resilient chucking members each integrally resiliently formed on the sleeve and sloping rearwardly upwardly from the leading edge portion towards a trailing edge portion of the sleeve to be resiliently compressibly engaged with the wall opening, a notch circumferentially cut out in the sleeve and diverging rearwardly from the leading edge portion towards the trailing edge portion, a pair of ridge portions formed on each said chucking member and respectively juxtapositioned to the notch and each said ridge portion having said plurality of ratchet teeth gradationally formed on the ridge portion; having each tooth of the ratchet teeth forwardly sliding over a rim of the wall opening when forwardly inserting the front tube portion of the cable connector through the wall opening, and each said tooth rearwardly retarded by the rim of the wall opening, thereby limiting a backlash movement of the adaptor and the cable connector as coupled with the adaptor.

2. An adaptor according to claim 1, wherein said notch is formed as a Y shape, and including a front slit linearly cut out in a front portion of the sleeve, and a diverging port enlarged rearwardly from the front slit towards the trailing edge portion of the sleeve, having the pair of ridge portions juxtapositionally formed on opposite sides of the diverging port and each said ridge portion having the plurality of ratchet teeth gradationally formed on the ridge portion, whereby upon a forward insertion of the cable connector into the wall opening of the box wall of the junction box, each said resilient chucking member will be compressed radially by the rim of the wall opening to radially fasten the split sleeve on the front tube portion of the cable connector, and the rim of the wall opening of the box wall will be bitten or engaged by each said tooth of the ratchet teeth to thereby lock the adaptor and cable connector on the wall of the junction box.

3. An adaptor according to claim 1, wherein said adaptor includes a free-end slit longitudinally cut out through a length of the sleeve to be releasably coupled with the cable connector.

4. An adaptor according to claim 1, wherein said adaptor further includes a limiting ring, retained in between the front arrow-head portion of the cable connector and the leading edge portion of the sleeve, to absolutely prevent a backward retraction of the cable connector.

* * * * *